US009574411B2

(12) United States Patent
Behrens

(10) Patent No.: US 9,574,411 B2
(45) Date of Patent: Feb. 21, 2017

(54) COILED TUBING UNIT LOCKING KNEE-JOINT MECHANISMS

(71) Applicant: PREMIER COIL SOLUTIONS, INC., Waller, TX (US)

(72) Inventor: Randall Dean Behrens, Sealy, TX (US)

(73) Assignee: Premier Coil Solutions, Inc., Waller, TX (US)

( * ) Notice: Subject to any disclaimer, the term of this patent is extended or adjusted under 35 U.S.C. 154(b) by 51 days.

(21) Appl. No.: 14/718,978

(22) Filed: May 21, 2015

(65) Prior Publication Data

US 2016/0040489 A1 Feb. 11, 2016

Related U.S. Application Data

(63) Continuation-in-part of application No. 14/454,948, filed on Aug. 8, 2014.

(51) Int. Cl.
*E21B 19/22* (2006.01)

(52) U.S. Cl.
CPC ..... *E21B 19/22* (2013.01)

(58) Field of Classification Search
CPC ..... E21B 19/22
USPC ..... 166/77.2, 77.3, 85.5; 175/162
See application file for complete search history.

(56) References Cited

U.S. PATENT DOCUMENTS

| | | | | |
|---|---|---|---|---|
| 4,673,055 | A | 6/1987 | Gipson | |
| 5,244,046 | A | 9/1993 | Council et al. | |
| 5,839,514 | A | 11/1998 | Gipson | |
| 6,209,944 | B1 | 4/2001 | Billiu et al. | |
| 8,161,589 | B1 | 4/2012 | Heffernan et al. | |
| RE43,410 | E | 5/2012 | Goode | |
| 9,316,067 | B1 * | 4/2016 | Lu | E21B 19/08 |
| 2003/0159821 | A1 * | 8/2003 | Andersen | E21B 19/22 166/77.1 |
| 2004/0020639 | A1 * | 2/2004 | Saheta | E21B 19/22 166/77.2 |
| 2004/0020640 | A1 * | 2/2004 | Saheta | E21B 19/22 166/77.3 |
| 2004/0156706 | A1 | 8/2004 | Weller et al. | |
| 2004/0211555 | A1 * | 10/2004 | Austbo | E21B 19/22 166/77.2 |

(Continued)

FOREIGN PATENT DOCUMENTS

| | | | |
|---|---|---|---|
| CN | 202117595 | U | 1/2012 |
| WO | 2008068546 | A1 | 6/2008 |

OTHER PUBLICATIONS

Baycor International Home, Baycor International [online], May 16, 2014, retrieved on Oct. 10, 2015 from the Internet at: <http://web.archive.org/web20140516212533/http://baycorinternational.com/>, p. 3.

*Primary Examiner* — Blake Michener
(74) *Attorney, Agent, or Firm* — Lloyd L. Davis; Andrews Kurth Kenyon LLP

(57) ABSTRACT

A knee-joint mechanism for a folding gooseneck used in a coiled tubing unit, includes a main structure having a distal end pivotally attached thereto, the knee-joint mechanism including an articulated member attached between the main structure and the pivotally attached distal end of the gooseneck, the articulated member having a joint, and a cylinder attached between the main structure and the articulated member. The arm of the cylinder is extended to push the joint of the articulated member to an over-center position, thereby locking the articulated member.

7 Claims, 6 Drawing Sheets

(56) References Cited

U.S. PATENT DOCUMENTS

| | | | | |
|---|---|---|---|---|
| 2007/0095525 | A1* | 5/2007 | Austbo | E21B 19/22<br>166/77.2 |
| 2007/0209791 | A1 | 9/2007 | Havinga | |
| 2008/0296013 | A1 | 12/2008 | Pleskie | |
| 2013/0056276 | A1 | 3/2013 | Rousseau et al. | |

* cited by examiner

COILED TUBING UNIT LOCKING KNEE-JOINT MECHANISMS

CROSS-REFERENCE TO RELATED APPLICATIONS

This application is a continuation-in-part claiming benefit of U.S. application Ser. No. 14/454,948 filed Aug. 8, 2014, which is incorporated herein by reference in its entirety.

FIELD

Embodiments disclosed herein relate to a coiled tubing unit, more particularly, locking knee-joint mechanisms used in coiled tubing units.

BACKGROUND AND SUMMARY

The main engine of a coiled tubing unit is the injector head. This component contains the mechanism to push and pull the coiled tubing in and out of the hole. An injector head has a curved guide beam on top called a "gooseneck" which threads the coiled tubing into the injector head. Below the injector head is the stripper, which contains rubber pack-off elements providing a seal around the tubing to isolate the well's pressure. Below the stripper is a blowout preventer, which provides the ability to cut the coiled tubing and seal the well bore and hold the seal around the tubing.

In one aspect, embodiments disclosed here relate to a knee-joint mechanism for a folding gooseneck used in a coiled tubing unit, the gooseneck including a main structure having a distal end pivotally attached thereto, the knee-joint mechanism including an articulated member attached between the main structure and the pivotally attached distal end of the gooseneck, the articulated member having a joint, and a cylinder attached between the main structure and the articulated member, wherein an arm of the cylinder is extended to push the joint of the articulated member to an over-center position, thereby locking the articulated member.

In another aspect, embodiments disclosed herein relate to methods of manipulating a pivoting distal end of a gooseneck, the distal end pivotally connected at one end to a main structure of the gooseneck, methods including attaching an articulated member having a joint between the pivoting distal end and the main structure, attaching a cylinder between the main structure and the articulated member, and extending an arm of the cylinder, thereby pushing the joint of the articulated member to an over-center position, thereby locking the articulated member.

In yet other aspects, embodiments disclosed herein relate to a coiled tubing unit including an injector head, a gooseneck mounted on top of the injector head, the gooseneck comprising a distal pivoting end attached to a main structure, and a knee-joint mechanism for manipulating the distal pivoting end of the gooseneck, the knee-joint mechanism including an articulated member attached between the distal end and the main structure, the articulated member having a joint and a cylinder attached between the main structure and the articulated member, wherein an arm of the cylinder is extended to push the joint of the articulated member to an over-center position, thereby locking the articulated member.

BRIEF DESCRIPTION OF THE DRAWINGS

The invention is illustrated in the accompanying drawings wherein.

DETAILED DESCRIPTION

Figure 1:
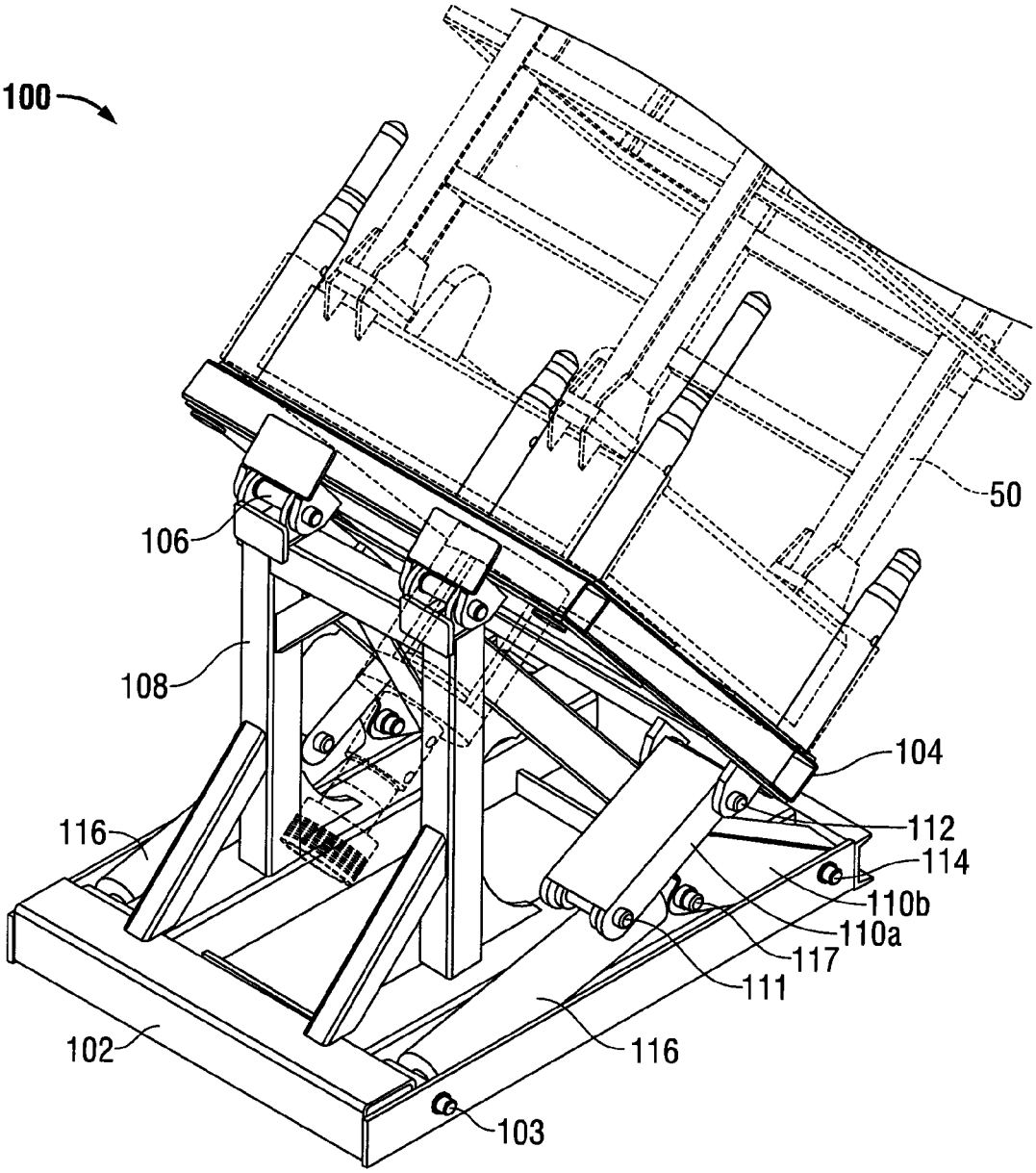
FIG. 1 illustrates a perspective view of an embodiment of an injector head tilt mechanism in a collapsed position.

Components of coiled tubing units are disclosed having locking knee joint mechanisms. For example, an injector head tilt mechanism and method for raising an injector head is disclosed. The injector head tilt mechanism may be on a coiled tubing unit. The coiled tubing unit may include a complete set of equipment necessary to perform standard continuous-length tubing operations in the field. For example, the coiled tubing unit may comprise a reel for storage and transport of coiled tubing, an injector head to provide surface drive force to run and retrieve coiled tubing, a control cabin from which an equipment operator may monitor and control the coiled tubing, and a power pack to generate hydraulic and pneumatic power required to operate the coiled tubing unit. The coiled tubing units may further comprise other equipment for continuous-length or coiled tubing operations in the field. Moreover, in certain embodiments the coiled tubing unit may comprise onshore coiled tubing units such as a truck mounted coiled tubing unit or larger trailer mounted coiled tubing units. Still further, in other embodiments the coiled tubing unit may comprise offshore coiled tubing units such as those mounted on a lift boat, barge, offshore platform or any other offshore structure.

An injector head may be mounted on a tiltable platform above a substantially horizontal base structure. Typically, the base structure may be mounted on a truck or trailer. One end of the tiltable platform is attached to the base structure at a pivot mount, e.g., pinned or otherwise. The tilt mechanism disclosed herein manipulates the tiltable platform relative to the base structure to raise and lower the injector head for use or transport. The tilt mechanism includes an articulated member and at least one extendable cylinder. One or more cylinders extend to push a joint of the articulated member to an over-center position, thereby locking the articulated member. In the event hydraulic cylinders are used, this allows the articulated member to substantially fully support the load without the need for hydraulic pressure in the cylinders. Thus, a loss of hydraulic power may not adversely affect the system.

The tilt mechanism may include an articulated member. The articulated member may have a joint coupling first and second arms of the member. For example, the joint may include a pin inserted through holes in the arms of the articulated member, or any other type of joint. The first arm may be connected to a pivot point (e.g., pinned or otherwise) on the tiltable platform at an end opposite the joint. The second arm may be connected to a pivot point (e.g., pinned or otherwise) on the base structure at an end opposite the joint.

The tilt mechanism further includes a cylinder having an extendable arm. The cylinder may be attached between the base structure and the articulated member. For example, the cylinder may be attached at a pivot point (e.g., pinned or otherwise) of the base structure and a pivot point (e.g., pinned or otherwise) on the second arm of the articulated member. Alternatively, the cylinder could be attached at a pivot point (not shown) on the first arm. In one embodiment, the cylinder may be a hydraulic cylinder in fluid communication at any pressure with a hydraulic fluid source. In other embodiments, the cylinder may be pneumatic or electric. In yet other embodiments, the cylinder may be mechanical. The tilt mechanism may include one or more extendable cylinders and articulated members on each side of the injector head.

In another example, a locking knee joint mechanism for a folding or pivoting gooseneck is disclosed. An injector gooseneck includes a main structure mounted on top of an injector head and a distal or end structure pivotally connected to the main structure at a pivot point by a pin or otherwise.

The knee-joint mechanism includes an articulated member. The articulated member has a joint coupling first and second arms of the member. The first arm is connected to a pivot point on the second structure of the gooseneck at an end opposite the joint. The second arm is connected to a pivot point on the first structure of the gooseneck at an end opposite the joint.

The knee-joint further includes a cylinder having an extendable arm. The cylinder may be attached between the gooseneck main structure and the articulated member. For example, the cylinder may be attached at a pivot point of the gooseneck main structure and a pivot point on the second arm of the articulated member. In one embodiment, the cylinder may be a hydraulic cylinder in fluid communication at any pressure with a hydraulic fluid source. In other embodiments, the cylinder may be pneumatic or electric. In yet other embodiments, the cylinder may be mechanical. The knee joint may include one or more extendable cylinders and articulated members on each side of the gooseneck.

Figure 2:
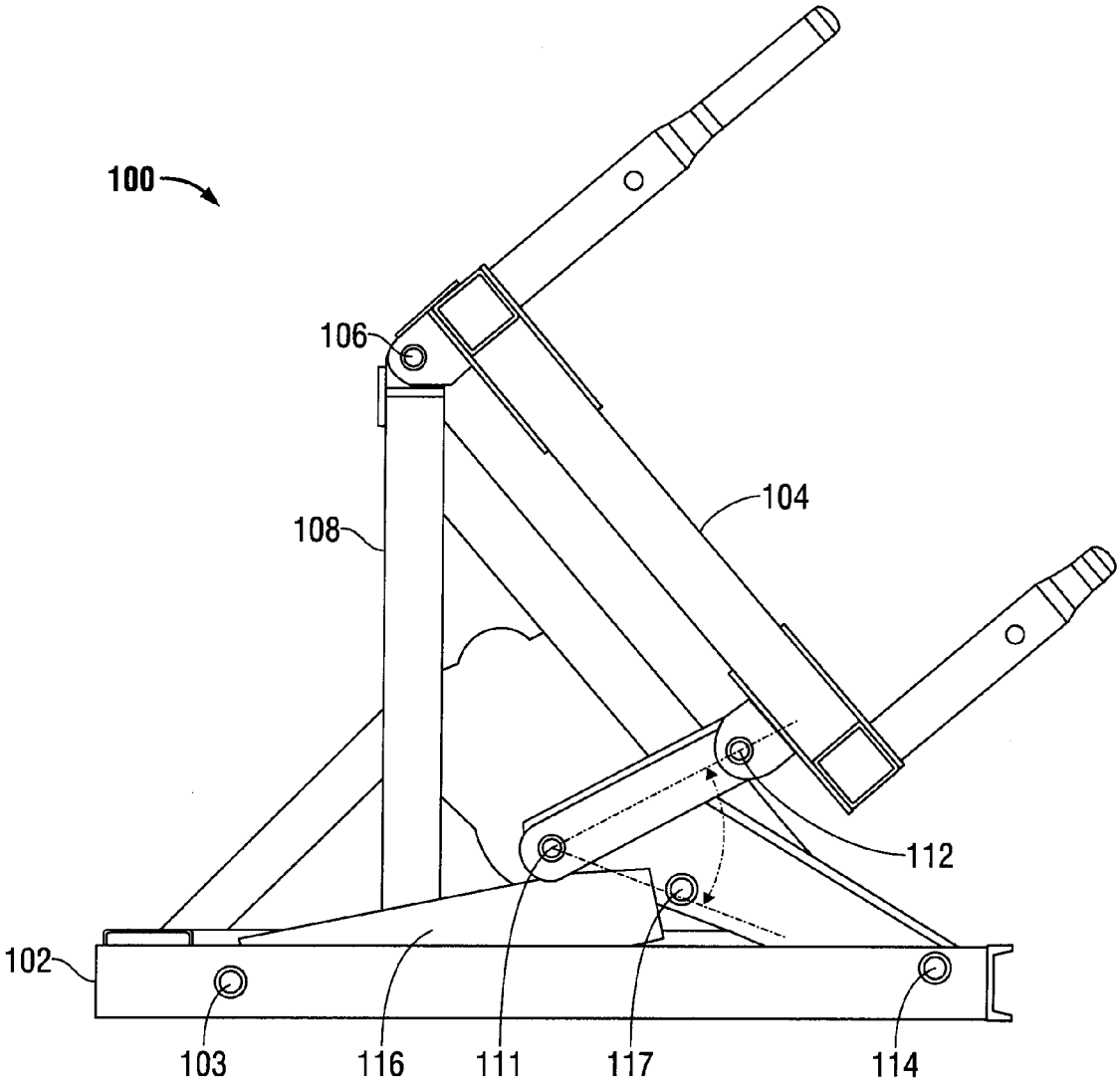
FIG. 2 illustrates a side view of the injector head tilt mechanism of FIG. 1.
Figure 3:
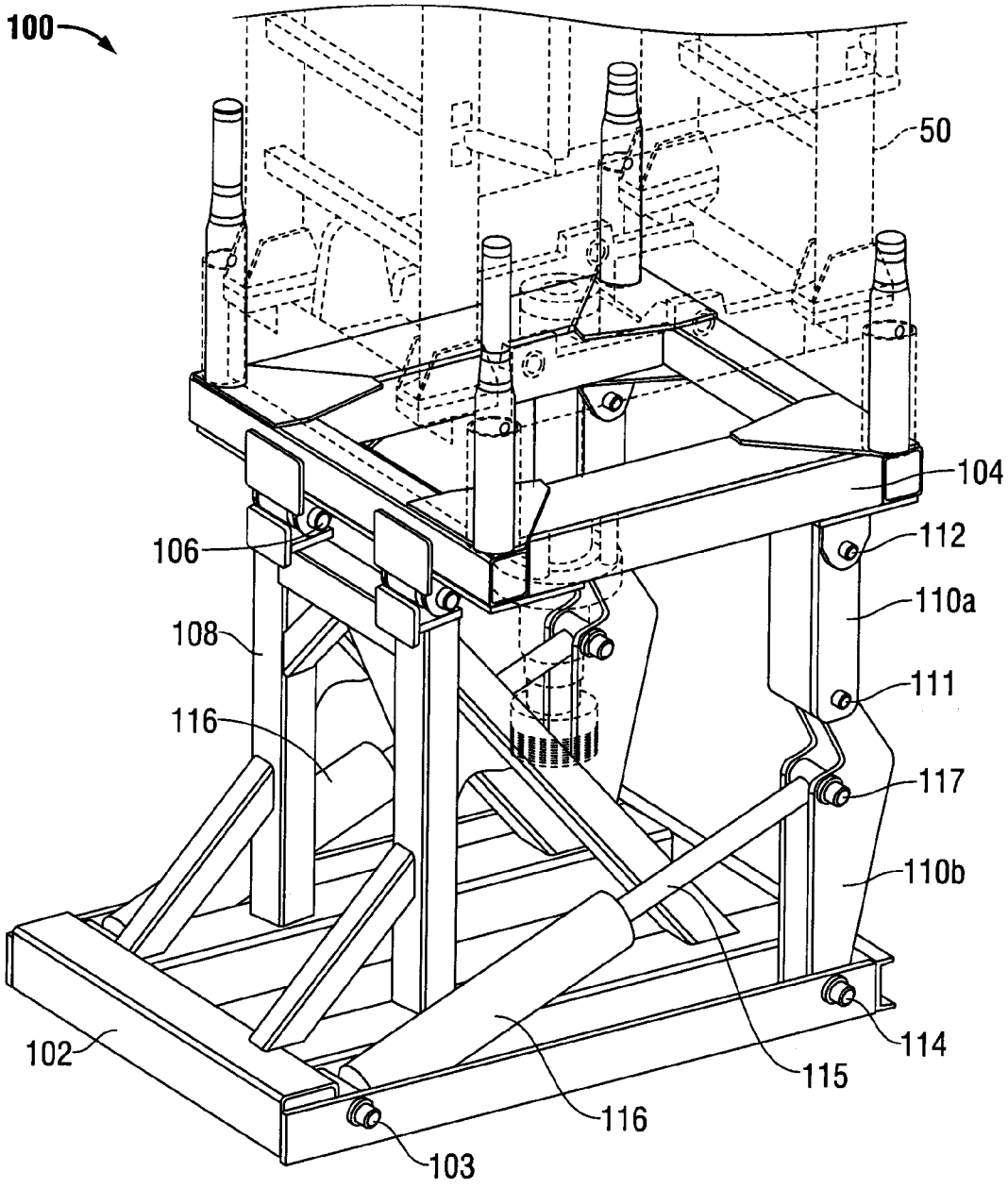
FIG. 3 illustrates a perspective view of an embodiment of an injector head tilt mechanism in an extended position.

FIGS. 1-3 illustrate an embodiment of an injector head tilt mechanism 100. An injector head 50 is mounted on a tiltable platform 104 by any means. The tiltable platform 104 is attached at one end to a pivot point 106, e.g. pinned or otherwise. The pivot point 106 may be located on the distal end of a rigid structure 108 extending upward from a substantially horizontal base structure 102. The base structure 102 may be mounted on a truck or trailer. The base structure 102 may be a commonly known weldment.

The tilt mechanism 100 includes an articulated member 110. The articulated member 110 has a joint 111 coupling first and second arms (110*a*, 110*b*) of the member 110. For example, the joint 111 may include a pin inserted through holes in the arms of the articulated member 110, or any other type of joint. The first arm 110*a* is connected to a pivot point 112 (e.g., pinned or otherwise) on the tiltable platform 104 at an end opposite the joint 111. The second arm 110*b* is connected to a pivot point 114 (e.g., pinned or otherwise) on the base structure 102 at an end opposite the joint 111.

The tilt mechanism 100 further includes a cylinder 116 having an extendable arm 115. The cylinder 116 may be attached between the base structure 102 and the articulated member 110. For example, the cylinder 116 may be attached at a pivot point 103 (e.g., pinned or otherwise) of the base structure 102 and a pivot point 117 (e.g., pinned or otherwise) on the second arm 110*b* of the articulated member 110. Alternatively, the cylinder 116 could be attached at a pivot point (not shown) on the first arm 110*a*. In one embodiment, the cylinder 116 may be a hydraulic cylinder in fluid communication at any pressure with a hydraulic fluid source. In other embodiments, the cylinder 116 may be pneumatic or electric. In yet other embodiments, the cylinder 116 may be mechanical. The tilt mechanism 100 may include one or more extendable cylinders and articulated members on each side of the injector head.

During transport or at other times of nonuse, the injector tilt mount 100 is in the collapsed position (shown in FIG. 1) where the injector head 50 is tilted at an angle, that is, a longitudinal axis of the injector head 50 is not vertical. During use, the injector tilt mount 100 is in the extended position where the longitudinal axis of the injector head 50 is substantially vertical. Methods of using the injector tilt mount include raising the injector head from a collapsed position to an extended position for use, and then lowering the injector head from the extended position to the collapsed position for storage or transport.

To raise the injector head to an extended position (shown in FIG. 3), the cylinders 116 are actuated to extend a cylinder arms 115. The cylinder arms 115 push each respective articulated member 110 near the joint 111 which straightens each articulated member 110 and raises an end of the tiltable platform 104, and accordingly, the injector head 50. Joints 111 of each articulated member 110 are pushed to an over-center position, that is, where the first arm 110*a* and second arm 110*b* effectively form a rigid member. In a fully extended position, the articulated member is locked and the injector head 50 and tiltable platform 104 do not rest on the cylinders. In the event that the cylinders are hydraulic and communicating with a hydraulic fluid source, the injector head 50 and tiltable platform 104 do not rest on the hydraulic system, that is, they do not exert back pressure on the hydraulic system because the articulated member is locked. To lower the injector head, the cylinder arms are retracted.

The first arm 110*a* and second arm 110*b* of the articulated member 110 are configured to be moved to an over-center position in an extended position of the tilt mechanism. Initially, in a collapsed position, the first arm 110*a* and second arm 110*b* may form an acute angle $\alpha$. In an extended position, the first arm 110*a* and second arm 110*b* may form an obtuse angle $\alpha$, or an angle $\alpha$ greater than an obtuse angle. As used herein, an "over-center" position may be angle $\alpha$ substantially equal to or greater than 180 degrees. In certain embodiments, the first arm 110*a* and second arm 110*b* may engage each other in an extended position, thereby locking the articulated member 110.

In other embodiments, one or more cylinders may be attached to the tiltable platform so that the cylinders push on the tiltable platform. When the cylinder is fully extended it may be mechanically locked by any means. In yet other embodiments, when the cylinder is fully extended other mechanical safety locks may be manually or automatically raised into position to support the tiltable platform.

Figure 4:
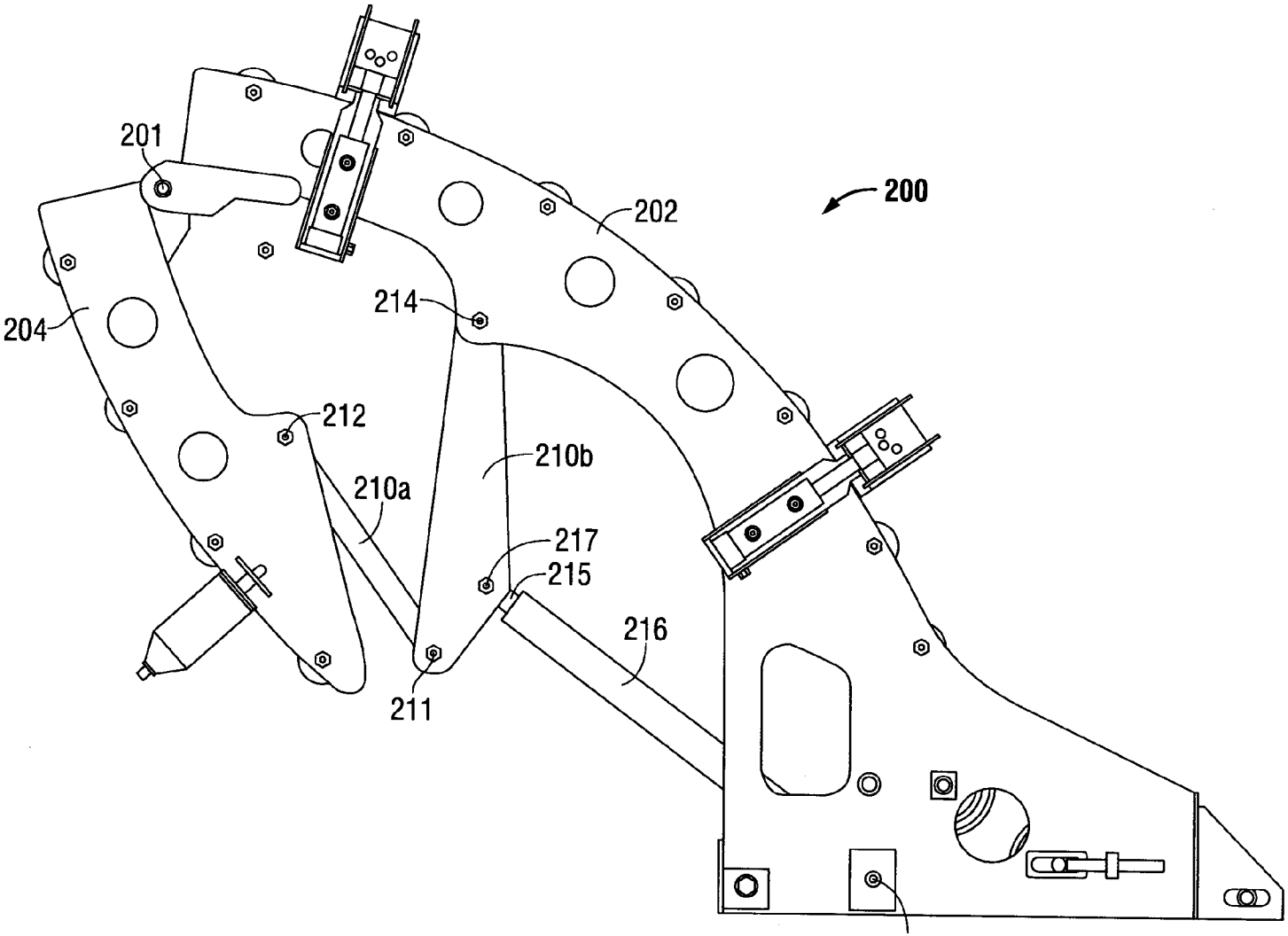
FIG. 4 illustrates a side view of an embodiment of a gooseneck locking knee-joint mechanism in a collapsed position.
Figure 5:
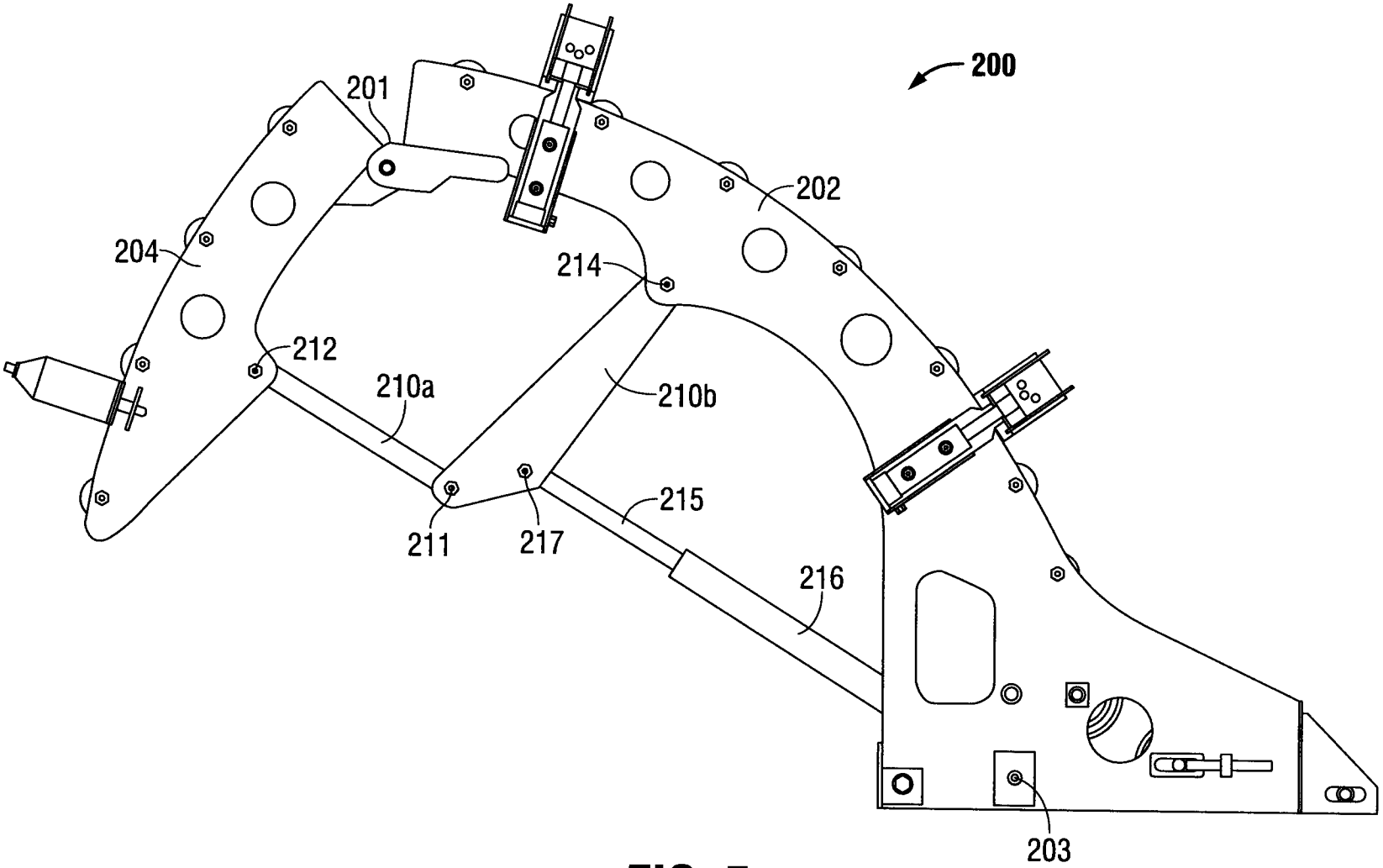
FIG. 5 illustrates a side view of an embodiment of a gooseneck locking knee-joint mechanism in an intermediate extended position.
Figure 6:
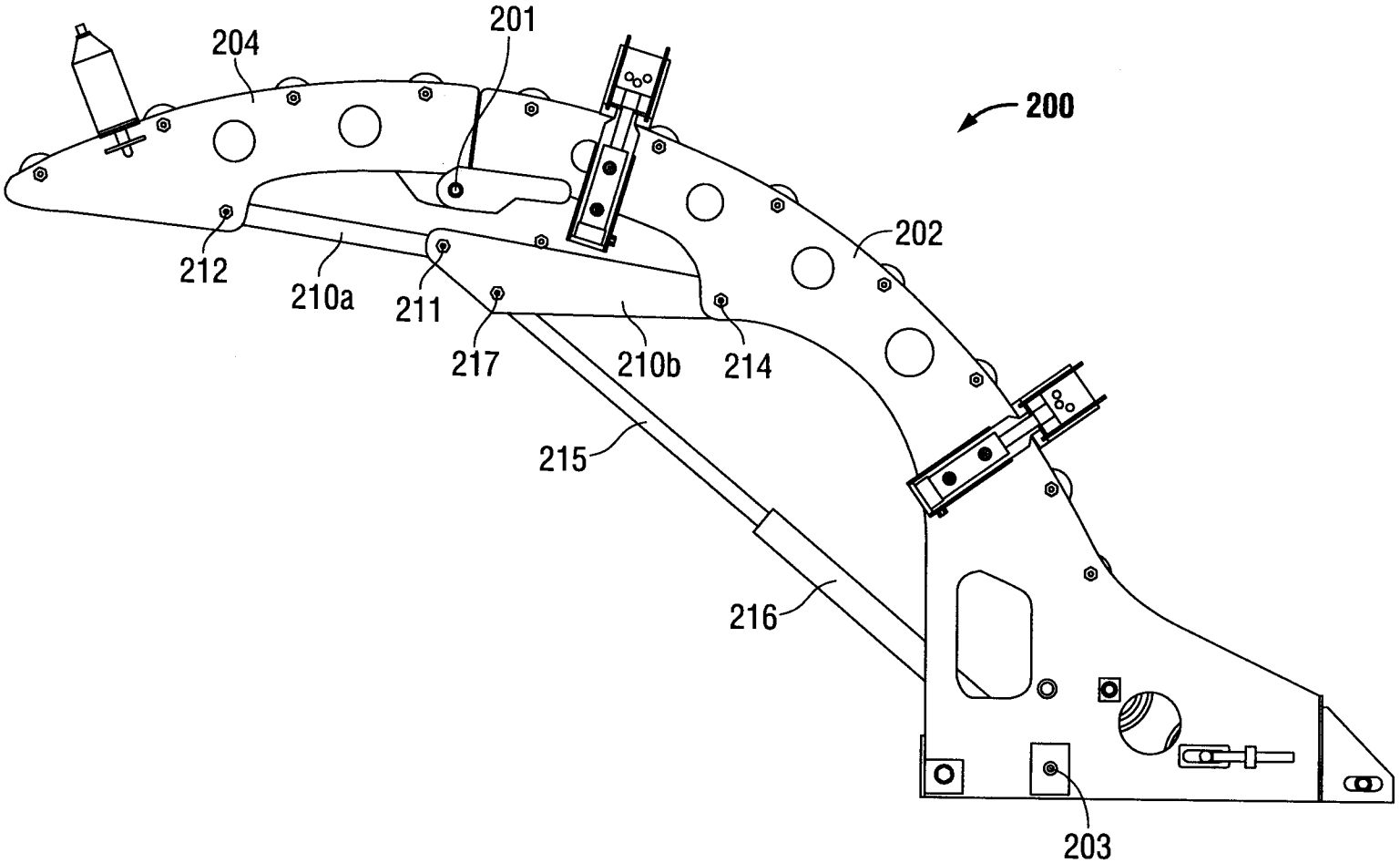
FIG. 6 illustrates a side view of an embodiment of a gooseneck locking knee-joint mechanism in a fully extended position.

FIGS. 4-6 illustrate an embodiment of an injector gooseneck locking knee joint mechanism 200. An injector gooseneck includes a main structure 202 mounted on top of an injector head (not shown), and a distal or end structure 204 pivotally connected to the main structure 202 at a pivot point 201 by a pin or otherwise.

The knee-joint mechanism 200 includes an articulated member 210. The articulated member 210 has a joint 211 coupling first and second arms (210*a*, 210*b*) of the member 210. For example, the joint 211 may include a pin inserted through holes in the arms of the articulated member 210, or any other type of joint. The first arm 210*a* is connected to a pivot point 212 (e.g., pinned or otherwise) on the distal pivoting end 204 of the gooseneck at an end opposite the joint 211. The second arm 210*b* is connected to a pivot point 214 (e.g., pinned or otherwise) on the main structure 202 of the gooseneck at an end opposite the joint 211.

The knee-joint 200 further includes a cylinder 216 having an extendable arm 215. The cylinder 216 may be attached between the gooseneck main structure 202 and the articulated member 210. For example, the cylinder 216 may be attached at a pivot point 203 (e.g., pinned or otherwise) of the gooseneck main structure 202 and a pivot point 217 (e.g., pinned or otherwise) on the second arm 210*b* of the articulated member 210. Alternatively, the cylinder 216 could be attached at a pivot point (not shown) on the first arm 210*a*. In one embodiment, the cylinder 216 may be a hydraulic cylinder in fluid communication at any pressure with a hydraulic fluid source. In other embodiments, the cylinder 216 may be pneumatic or electric. In yet other embodiments, the cylinder 216 may be mechanical. The knee joint 200 may include one or more extendable cylinders and articulated members on each side of the gooseneck.

During transport or at other times of nonuse, the gooseneck knee-joint mechanism 200 is in the collapsed position (shown in FIG. 4) where the distal end 204 of the gooseneck is folded or rotated downward. During use, the gooseneck is in the extended position where the distal end 204 of the gooseneck is rotated upward to form a common curvature with the main structure 202 of the gooseneck. Methods of using the gooseneck locking knee joint include raising the distal end 204 from a collapsed position to an extended position for use, and then lowering the distal end 204 from the extended position to the collapsed position for storage or transport.

To raise the distal end 204 to a fully extended position (shown in FIG. 6), the cylinder 216 is actuated to extend the cylinder arm 215. The cylinder arm 215 pushes the articulated member 210 near the joint 211, which straightens the articulated member 210 and raises the distal end 204 of the gooseneck. Joint 211 of the articulated member 210 is pushed to an over-center position, that is, where the first arm 210*a* and second arm 210*b* effectively forms a rigid member. In a fully extended position, the articulated member is locked, and the fully extended distal end 204 does not rest on the cylinder. In the event that the cylinder is hydraulic and communicating with a hydraulic fluid source, the folding gooseneck does not rest on the hydraulic system, that is, it does not exert back pressure on the hydraulic system because the articulated member is locked. To lower the injector head, the cylinder arm 215 is retracted.

The first arm 210*a* and second arm 210*b* of the articulated member 210 are configured to be moved to an over-center position in an extended position of the locking knee-joint. Initially, in a collapsed position, the first arm 210*a* and second arm 210*b* may form an acute angle $\alpha$. In an extended position, the first arm 210*a* and second arm 210*b* may form an obtuse angle $\alpha$, or an angle $\alpha$ greater than an obtuse angle. As used herein, an "over-center" position may be angle $\alpha$ substantially equal to or greater than 180 degrees. In certain embodiments, the first arm 210*a* and second arm 210*b* may engage each other in an extended position, thereby locking the articulated member 210.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A knee-joint mechanism for a folding gooseneck used in a coiled tubing unit, the gooseneck comprising a main structure having a distal end pivotally attached to the main structure, the knee joint mechanism comprising:

an articulated member attached between the main structure and the pivotally attached distal end of the gooseneck, the articulated member having a joint; and a hydraulic cylinder attached between the main structure and the articulated member, wherein an arm of the hydraulic cylinder is extended to push the joint of the articulated member to a position thereby locking the articulated member, and wherein there is substantially no backpressure on the hydraulic cylinder when the articulated member is locked.

2. The tilt mechanism of claim 1, wherein an angle between arms of the articulated member is substantially equal to or greater than 180 degrees in the position, the position comprising an over-center position.

3. A method of manipulating a pivoting distal end of a gooseneck, the distal end pivotally connected at one end to a main structure of the gooseneck, the method comprising:

attaching an articulated member having a joint between the pivoting distal end and the main structure;

attaching a hydraulic cylinder between the main structure and the articulated member; and extending an arm of the hydraulic cylinder, thereby pushing the joint of the articulated member to an over-center position, thereby locking the articulated member, and wherein there is substantially no backpressure on the hydraulic cylinder when the articulated member is locked.

4. The method of claim 3, further comprising creating an angle between arms of the articulated member substantially equal to or greater than 180 degrees in the over-center position.

5. The method of claim 3, further comprising retracting the arm of the cylinder.

6. A coiled tubing unit comprising:

an injector head;

a gooseneck mounted on top of the injector head, the gooseneck comprising a distal pivoting end attached to a main structure; and a knee-joint mechanism for manipulating the distal pivoting end of the gooseneck, the knee joint mechanism comprising:

an articulated member attached between the distal end and the main structure, the articulated member having a joint; and a hydraulic cylinder attached between the main structure and the articulated member, wherein an arm of the hydraulic cylinder is extended to push the joint of the articulated member to an over-center position, thereby locking the articulated member, and wherein there is substantially no backpressure on the hydraulic cylinder when the articulated member is locked.

7. The coiled tubing unit of claim 6, wherein an angle between arms of the articulated member is substantially equal to or greater than 180 degrees in the over-center position.

* * * * *